US011193678B2

(12) United States Patent
Kato et al.

(10) Patent No.: US 11,193,678 B2
(45) Date of Patent: Dec. 7, 2021

(54) OUTDOOR UNIT FOR AIR-CONDITIONING APPARATUS, AND AIR-CONDITIONING APPARATUS INCLUDING THE SAME

(71) Applicant: Mitsubishi Electric Corporation, Tokyo (JP)

(72) Inventors: Yohei Kato, Tokyo (JP); Tsubasa Tanda, Tokyo (JP); Yudai Sakabe, Tokyo (JP); Motoki Otsuka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 161 days.

(21) Appl. No.: 16/332,441

(22) PCT Filed: Nov. 29, 2016

(86) PCT No.: PCT/JP2016/085282
§ 371 (c)(1),
(2) Date: Mar. 12, 2019

(87) PCT Pub. No.: WO2018/100601
PCT Pub. Date: Jun. 7, 2018

(65) Prior Publication Data

US 2020/0080733 A1 Mar. 12, 2020

(51) Int. Cl.
*F24F 1/36* (2011.01)
*F24F 13/22* (2006.01)

(52) U.S. Cl.
CPC ..... *F24F 1/36* (2013.01); *F24F 13/222* (2013.01); *F24F 2013/227* (2013.01)

(58) Field of Classification Search
CPC ..... F28D 1/053; F28D 1/047; F28F 19/00; F28F 17/005; F24F 13/222; F24F 1/36;
(Continued)

(56) References Cited

U.S. PATENT DOCUMENTS 4,748,828 A 6/1988 Chang
7,210,305 B2 * 5/2007 Shin ..... F24F 1/36 62/285

(Continued)

FOREIGN PATENT DOCUMENTS

CN 1548850 A 11/2004
EP 2 180 267 A2 3/2009

(Continued)

OTHER PUBLICATIONS

Office Action dated Mar. 3, 2020 issued in corresponding JP patent application No. 2018-553516 (with English Translation).

(Continued)

*Primary Examiner* — Frantz F Jules
*Assistant Examiner* — Martha Tadesse
(74) *Attorney, Agent, or Firm* — Posz Law Group, PLC

(57) ABSTRACT

An outdoor unit for an air-conditioning apparatus includes a heat exchanger; a bottom plate; and a separation member configured to separate the bottom plate and the heat exchanger. The bottom plate includes a drainage passage that protrudes downward; and one or more drainage holes each formed to protrude downward from the drainage passage. The drainage passage includes a drainage surface inclined downward toward the one drain hole having a width larger than a width of the heat exchanger. The separation member is formed of a metal electrically less noble than a member forming the heat exchanger, or a resin member. The separation member is provided in the drainage passage and shaped to prevent closing of the drainage passage, in which a height to a surface on which the heat exchanger is placed is larger than a height to an upper surface of the drainage passage.

5 Claims, 4 Drawing Sheets

(58) Field of Classification Search
CPC ..... F24F 1/16; F24F 1/06; F24F 1/56; F24F 1/46
See application file for complete search history.

(56) References Cited

U.S. PATENT DOCUMENTS

| | | | | |
|---|---|---|---|---|
| 2005/0034471 | A1* | 2/2005 | Shin | F24F 1/36 62/285 |
| 2011/0154845 | A1* | 6/2011 | Ashida | F25B 47/006 62/282 |
| 2011/0241514 | A1* | 10/2011 | Nomura | F16L 59/065 312/405 |
| 2012/0196059 | A1* | 8/2012 | Fujimori | F25D 23/06 428/34.1 |
| 2014/0131024 | A1* | 5/2014 | Iwazaki | F24F 3/06 165/185 |
| 2014/0216092 | A1* | 8/2014 | Tashiro | F28F 17/005 62/276 |
| 2014/0298844 | A1* | 10/2014 | Luo | F24F 1/18 62/275 |
| 2014/0338384 | A1* | 11/2014 | Koike | F24F 1/36 62/285 |
| 2014/0374078 | A1* | 12/2014 | Ono | F24F 13/222 165/173 |
| 2016/0076779 | A1* | 3/2016 | Lee | F24F 1/10 62/508 |
| 2016/0076796 | A1* | 3/2016 | Lee | F24F 1/46 62/498 |

FOREIGN PATENT DOCUMENTS

| | | | | |
|---|---|---|---|---|
| EP | 2180267 | A2 * | 4/2010 | F24F 1/46 |
| EP | 2 787 289 | A1 | 10/2014 | |
| JP | S60-014426 | U1 | 1/1985 | |
| JP | S61-046365 | U1 | 3/1986 | |
| JP | S62-006617 | U1 | 1/1987 | |
| JP | 2000213779 | A * | 8/2000 | |
| JP | 2002081693 | A * | 3/2002 | |
| JP | 2005-114273 | A | 4/2005 | |
| JP | 2008-202889 | A | 9/2008 | |
| JP | 2010-164263 | A | 7/2010 | |
| JP | 2012193925 | A * | 10/2012 | F24F 1/06 |
| JP | 2013217525 | A * | 10/2013 | |
| WO | 2012/124457 | A1 | 9/2012 | |
| WO | 2013/005437 | A1 | 1/2013 | |

OTHER PUBLICATIONS

Office Action dated Jun. 1, 2020 issued in corresponding CN patent application No. 201680090743.X (and English translation).
Extended EP Search Report ("EESR") dated Feb. 7, 2017 issued in corresponding EP patent application No. 16901912.2.
International Search Report ("ISR") dated Jul. 25, 2018 issued in corresponding international patent application No. PCT/JP2016/085282 (and English translation thereof).

* cited by examiner (a)

(b)

OUTDOOR UNIT FOR AIR-CONDITIONING APPARATUS, AND AIR-CONDITIONING APPARATUS INCLUDING THE SAME

CROSS REFERENCE TO RELATED APPLICATION

This application is a U.S. national stage application of International Application No. PCT/JP2016/085282, filed on Nov. 29, 2016, the contents of which are incorporated herein by reference.

TECHNICAL FIELD

The present invention relates to an outdoor unit for an air-conditioning apparatus, and to an air-conditioning apparatus including the outdoor unit.

BACKGROUND

Hitherto, in an outdoor unit for an air-conditioning apparatus, there is mounted a cross fin-tube heat exchanger using aluminum or aluminum alloy for fins and a pipe, as typified by, for example, a parallel flow heat exchanger.

The cross fin-tube heat exchanger is provided on a bottom plate forming a part of an outer shell of the outdoor unit, and is held in direct contact with the bottom plate of the outdoor unit. Therefore, the bottom plate is typically formed by subjecting a steel plate to surface treatment such as rust prevention. However, when rain water or drain water from the heat exchanger stagnates on the bottom plate, the surface treatment for the bottom plate is degraded as time elapses, with the result that the steel plate is partially exposed.

When water is present between iron of the steel plate, which is exposed on the bottom plate, and the heat exchanger using aluminum or aluminum alloy, bimetallic contact is caused between iron and aluminum or aluminum alloy. As a result, in the heat exchanger which is made of aluminum or aluminum alloy being electrically less noble than iron, there may occur pitting corrosion being electrolytic corrosion caused by formation of a local cell. In particular, when the electrolytic corrosion occurs in a pipe, a failure such as leakage of refrigerant may occur.

In order to suppress such electrolytic corrosion, it has been proposed to provide a spacer, which is formed of metal being electrically less noble than aluminum or is formed of non-metal such as synthetic resin, between the bottom plate and the heat exchanger (for example, Patent Literature 1).

Meanwhile, in order to cause drain water from the heat exchanger to be discharged from the outdoor unit, a drain reservoir recess portion is formed in the bottom plate, and a drainage hole is formed in the drain reservoir recess portion (for example, Patent Literature 2). Further, in the outdoor unit disclosed in Patent Literature 2, in order to cause the drain water having dropped from the heat exchanger to be efficiently discharged from the outdoor unit, it has been proposed to incline the drain reservoir recess portion toward the drainage hole and to form a groove for guiding the drain water to the drainage hole.

PATENT LITERATURE

Patent Literature 1: Japanese Unexamined Patent Application Publication No. 2005-114273

Patent Literature 2: Japanese Unexamined Patent Application Publication No. Sho 62-006617

However, in the outdoor unit disclosed in Patent Literature 1, sediments may deposit in a drainage passage, or water may overflow, depending on a shape of the spacer. As a result, the bottom plate and the heat exchanger may involve a short circuit to cause local corrosion.

Further, in the outdoor unit disclosed in Patent Literature 2, the sediments are liable to stagnate in the groove formed in the drain reservoir recess portion.

Therefore, there is a fear in that the drain reservoir recess portion is entirely closed with the sediments having stagnated in the groove as a base point, with the result that drainage of the drain water is hindered. Further, when the drain reservoir recess portion is inclined to cause the flow of the drain water to concentrate at one drainage hole, there is difficulty in drainage of the drain water in case of clogging of the drainage hole.

SUMMARY

The present invention has been made in view of the problems in the above-mentioned related arts, and has an object to provide an outdoor unit for an air-conditioning apparatus being capable of suppressing corrosion of a heat exchanger and efficiently draining water such as drain water from the outdoor unit, and to provide an air-conditioning apparatus including the outdoor unit.

According to one embodiment of the present invention, there is provided an outdoor unit for an air-conditioning apparatus, including: a heat exchanger, which is provided in a main body of the outdoor unit and is configured to exchange heat between refrigerant flowing through a heat transfer tube and air to be taken in; a bottom plate forming a bottom surface of an outer shell of the main body; and a separation member, which is arranged on the bottom plate, receives the heat exchanger placed on the separation member, and is configured to separate the bottom plate and the heat exchanger from each other, the bottom plate including a drainage passage, which is formed at a position corresponding to an arrangement position of the heat exchanger, is formed so as to protrude downward in a vertical direction of the bottom plate, and is configured to drain water including drain water generated in the heat exchanger, and one or a plurality of drainage holes, which are each formed so as to protrude downward in the vertical direction from the drainage passage and are each configured to discharge the water flowing through the drainage passage to an outside, the drainage passage comprising a drainage surface inclined downward in the vertical direction toward one of the one or the plurality of drain holes, the drainage passage having a width being a dimension in a direction corresponding to a direction of flow of the air passing through the heat exchanger, which is larger than a width of the heat exchanger, the width being a dimension in a direction corresponding to the direction of flow of the air, the separation member being formed of a metal member, which is electrically less noble than a member forming the heat exchanger, or a resin member, the separation member being provided in the drainage passage and having a shape of preventing closing of the drainage passage, wherein a height from a reference position of the drainage passage to a surface on which the heat exchanger is placed is set larger than a height from the reference position to an upper surface of the drainage passage.

As described above, according to one embodiment of the present invention, a height from a reference position of the drainage passage to a surface on which the heat exchanger is placed is set larger than a height from the reference position to an upper surface of the drainage passage and a width of the drainage passage is set larger than a width of the heat exchanger. Further, the drainage passage having an inclination is formed in the bottom plate, and the drainage hole is formed in the drainage passage. With such a configuration, the corrosion of the heat exchanger can be suppressed, and the water such as drain water can be efficiently drained from the outdoor unit.

DETAILED DESCRIPTION

Embodiment

Now, description is made of an outdoor unit for an air-conditioning apparatus according to an embodiment of the present invention.

[Configuration of Air-Conditioning Apparatus]

Figure 1:
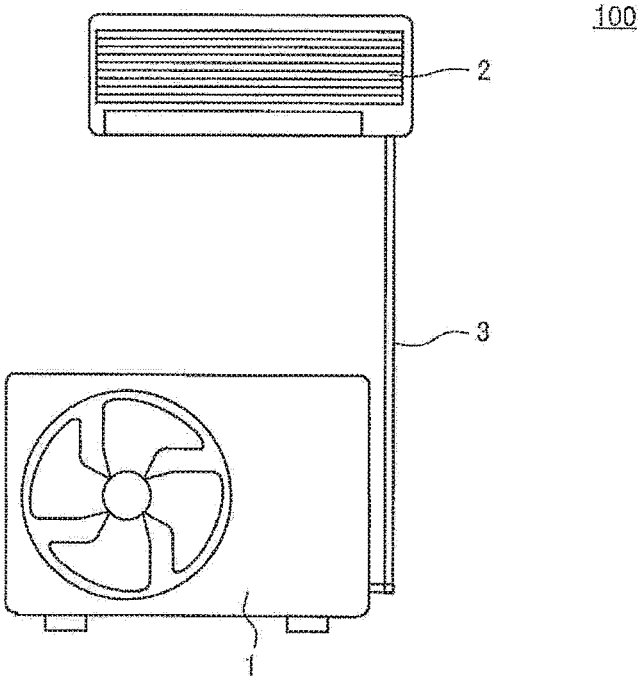
FIG. 1 is a schematic view for illustrating one example of a configuration of an air-conditioning apparatus according to an embodiment of the present invention.

FIG. 1 is a schematic view for illustrating one example of a configuration of an air-conditioning apparatus 100 according to this embodiment. As illustrated in FIG. 1, the air-conditioning apparatus 100 includes an outdoor unit 1 and an indoor unit 2. The outdoor unit 1 and the indoor unit 2 are connected to each other by a refrigerant pipe 3.

The outdoor unit 1 is installed in a space outside a construction such as a building or a house. The outdoor unit 1 generates cooling energy or heating energy and supplies the generated cooling energy or heating energy to the indoor unit 2. The outdoor unit 1 includes, for example, an outdoor heat exchanger (hereinafter simply referred to as "heat exchanger" as appropriate), which functions as a condenser during a cooling operation and functions as an evaporator during a heating operation.

The indoor unit 2 is installed in a space to be air-conditioned, such as a living room or a server room in a building. The indoor unit 2 uses the cooling energy or heating energy supplied from the outdoor unit 1 to supply the cooling air or heating air to the space to be air-conditioned, thereby conditioning air in the space to be air-conditioned. The indoor unit 2 includes, for example, an indoor heat exchanger, which functions as an evaporator during the cooling operation and functions as a condenser during the heating operation.

[Structure of Outdoor Unit]

Figure 2:
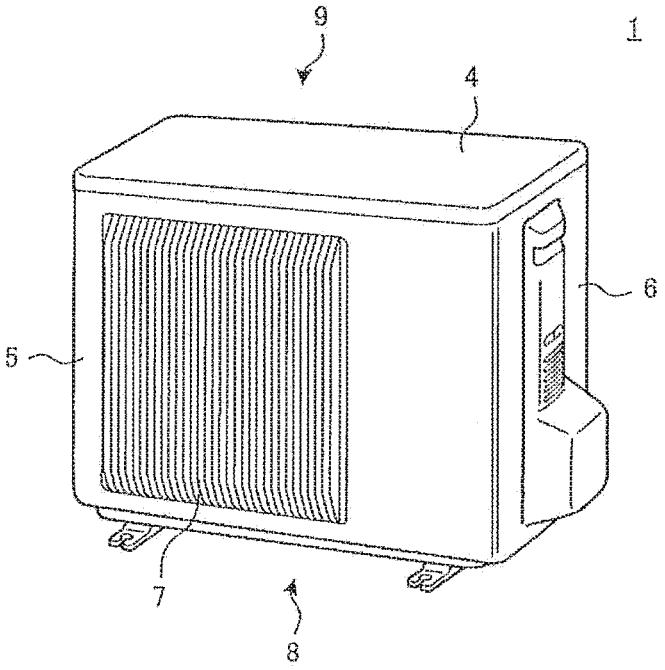
FIG. 2 is a schematic view for illustrating one example of an outer shape of an outdoor unit of FIG. 1.

FIG. 2 is a schematic view for illustrating one example of an outer shape of the outdoor unit 1 of FIG. 1. The outdoor unit 1 has an outer shell formed by a top plate 4, a front panel 5, a right side panel 6, a fan grille 7, a bottom plate 8, and a back panel 9. The outdoor unit 1 receives, for example, a heat exchanger 10 described later, a separation member 20, a compressor (not shown), and a fan (not shown). The separation member 20 is configured to separate the heat exchanger 10 from the bottom plate. The compressor is configured to compress refrigerant and discharge the compressed refrigerant. The fan is configured to supply air to the heat exchanger 10.

The top plate 4 constitutes an upper surface of the outdoor unit 1. The front panel 5 constitutes a part of a front surface and a left side surface of the outdoor unit 1. The right side panel 6 constitutes a right side surface and a part of a back surface of the outdoor unit 1. The fan grille 7 is provided to the front panel and constitutes a part of the front surface. The bottom plate 8 constitutes a bottom surface of the outdoor unit 1. The back panel 9 constitutes a part of a back surface of the outdoor unit 1.

Figure 3:
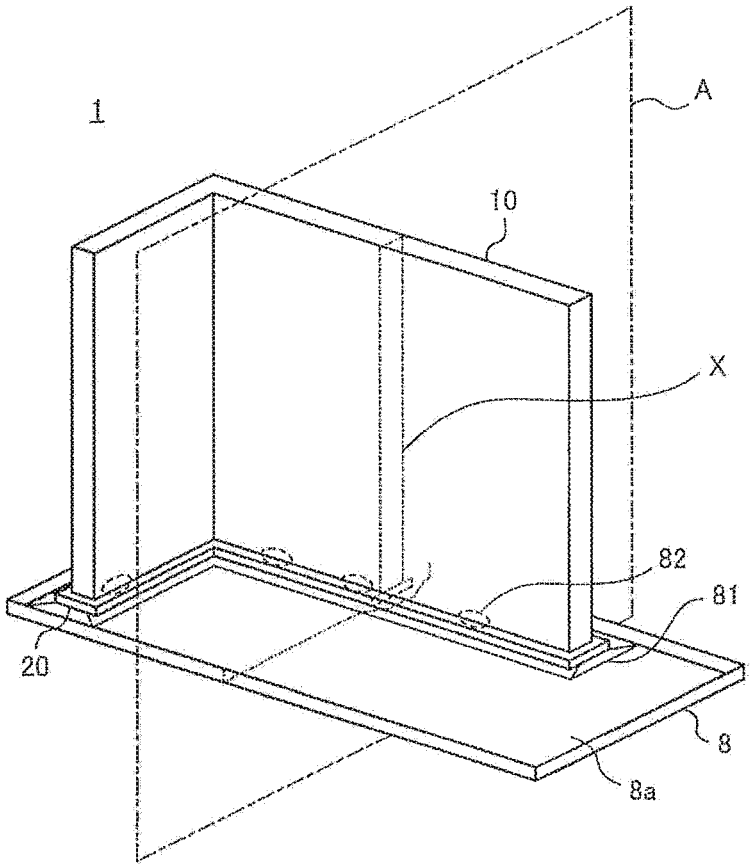
FIG. 3 are schematic views for illustrating an internal structure of the outdoor unit according to the embodiment.
Figure 3:
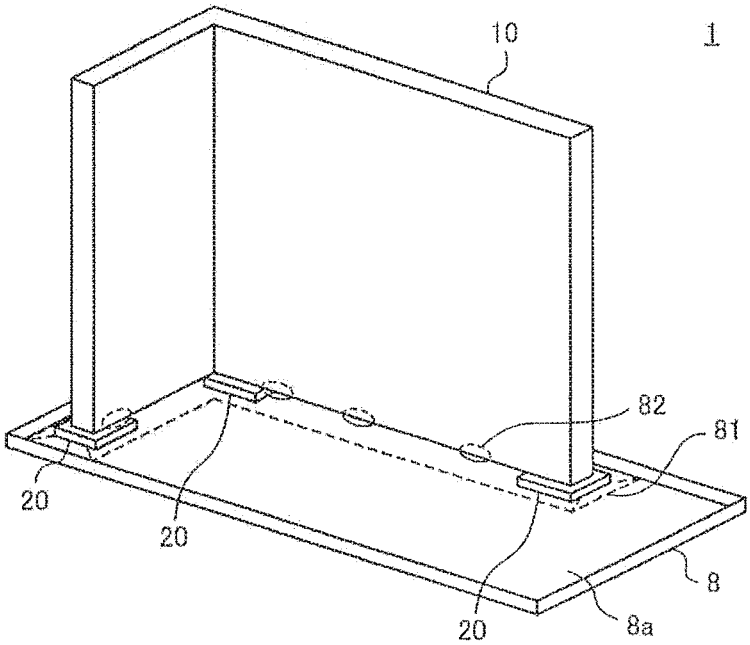
Figure 4:
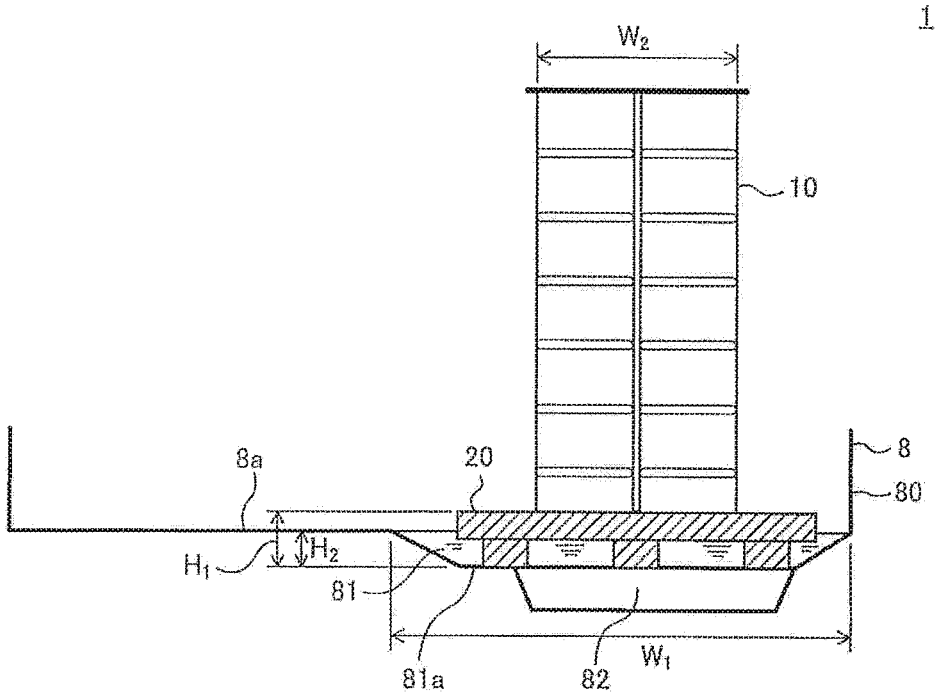
FIG. 4 is a schematic view for illustrating the internal structure of the outdoor unit when the outdoor unit of FIG. 3 is viewed from a right side.
Figure 5:
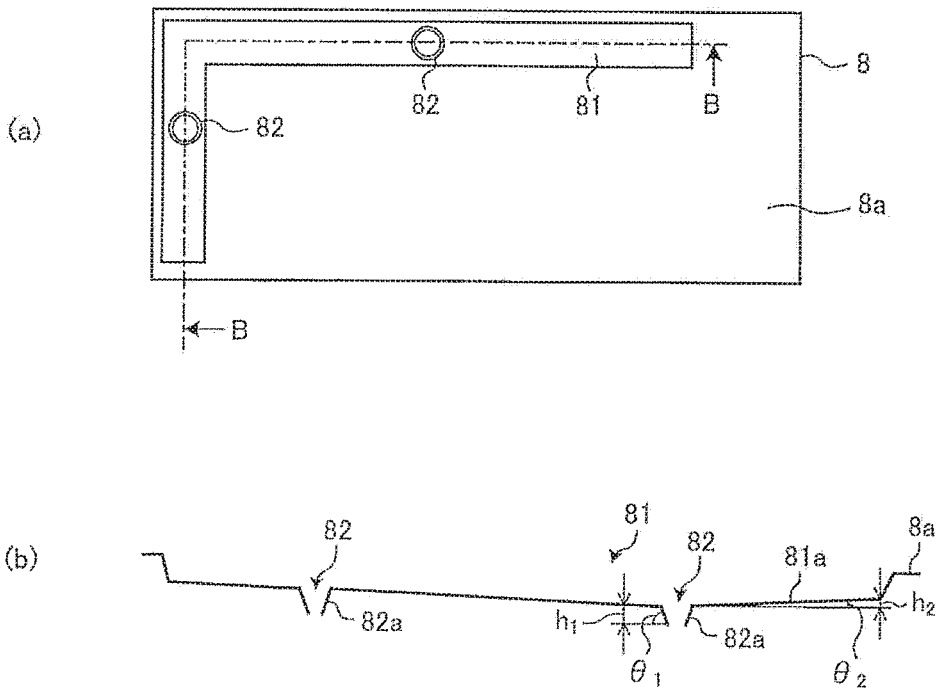
FIG. 5 are schematic views for illustrating one example of a structure of a bottom plate of FIG. 3.

FIG. 3(*a*) and FIG. 3(*b*) are schematic views for illustrating an internal structure of the outdoor unit 1 according to this embodiment. FIG. 4 is a schematic view for illustrating the internal structure of the outdoor unit 1 when the outdoor unit 1 of FIG. 3 is viewed from a right side. FIG. 5 are schematic views for illustrating one example of a structure of the bottom plate 8 of FIG. 3.

In FIG. 3 and FIG. 4, the internal structure of the outdoor unit 1 is partially illustrated, and illustrations of portions which are other than portions related to the features of this embodiment are omitted. FIG. 4 is a schematic view for illustrating a cross section of the outdoor unit 1 illustrated in FIG. 3(*a*), which is indicated by one-dot chain lines X and taken along a plane A, as viewed from the right side.

(Heat Exchanger)

The heat exchanger 10 is, for example, a fin-tube type heat exchanger including fins and a heat transfer tube, as typified by a parallel flow heat exchanger.

The fins and the heat transfer tube are made of aluminum or aluminum alloy. For example, the heat exchanger 10 is formed so as to have an L-shaped horizontal cross-sectional shape and is arranged so as to extend along the left side portion of the front panel 5 and along the back panel 9.

The heat exchanger 10 is configured to exchange heat between refrigerant and air that is taken into the outdoor unit 1 by the fan. The heat exchanger 10 is configured to condense and liquefy the refrigerant during the cooling operation and to evaporate and gasify the refrigerant during the heating operation. The heat exchanger 10 is arranged on the bottom plate 8 through intermediation of the separation member 20.

(Separation Member)

The separation member 20 is provided so as to separate the bottom plate 8 and the heat exchanger 10 from each other. For example, the heat exchanger 10 is placed on the separation member 20 so as to be in surface-contact with the separation member 20. The separation member 20 is formed of, for example, a metal member that is electrically equivalent to or less noble than the heat exchanger 10, or a non-metal member such as resin. Such a configuration is employed so as to prevent corrosion of the heat exchanger 10 in the case where the heat exchanger 10 and the separation member 20 are electrically connected to each other through, for example, water or sediments.

For example, as illustrated in FIG. 3(*a*), the separation member 20 is formed into a shape in conformity with a shape of the bottom surface of the heat exchanger 10 so that the entire bottom surface of the heat exchanger 10 is held in contact with the separation member 20. Further, the separation member 20 is not limited to this shape. For example, as illustrated in FIG. 3(*b*), the separation member 20 may be formed into a shape of being held in contact with a part of the bottom surface of the heat exchanger 10. In this case, it is preferred that a plurality of separation members 20 be provided to enable reliable placement of the heat exchanger 10 and that the separation members 20 be held in contact with the heat exchanger 10 at a plurality of locations.

(Bottom Plate)

The bottom plate 8 constitutes the bottom surface of the outdoor unit 1. The bottom plate 8 is mainly formed of a steel plate made of iron, which is a metal member being electrically more noble than the heat exchanger 10, and is subjected to, for example, a rust prevention coating treatment. On a peripheral edge of the bottom plate 8, for example, there is formed a flange 80 which stands vertically upright.

As illustrated in FIG. 4, the bottom plate 8 has a drainage passage 81 for guiding rain water and water such as drain water generated in the heat exchanger 10. The drainage passage 81 is formed in a recessed shape protruding downward in a vertical direction from a bottom surface portion 8*a* of the bottom plate 8. Further, the separation member 20 is provided on the drainage passage 81, and the heat exchanger 10 is placed on the separation member 20. That is, the drainage passage 81 is formed directly below a position at which the heat exchanger 10 is arranged.

As illustrated in FIG. 5(*a*), the drainage passage 81 has one or a plurality of drainage holes 82 for discharging water flowing through the drainage passage 81 to an outside. The drainage holes 82 are formed in the drainage surface 81*a* being the bottom surface portion of the drainage passage 81. As illustrated in FIG. 5(*b*), the drainage surface 81*a* of the drainage passage 81 is, for example, inclined on the bottom surface side toward a predetermined one drainage hole 82. With this configuration, an overflow of water flowing through the drainage passage 81 and a diffusion of the water to the entire bottom plate 8 is suppressed, thereby being capable of efficiently discharging the water in the drainage passage 81 to the outside.

The drainage hole 82 is formed so as to have a drainage flow passage 82*a* further protruding downward in the vertical direction than the drainage surface 81*a*. The drainage flow passage 82*a* of the drainage hole 82 is formed so as to be inclined in a tapered shape being tapered downward in the vertical direction.

Figure 6:
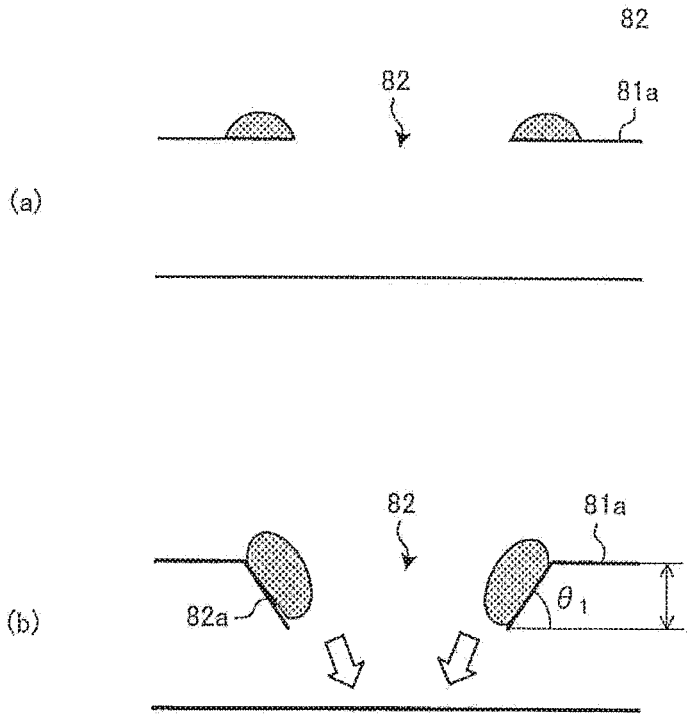
FIG. 6 are schematic views for illustrating drainage holes of FIG. 5.

FIG. 6 are schematic views for illustrating the drainage holes 82 of FIG. 5. When the water such as drain water is discharged through the drainage passage 81 to an outside, water having dropped to the drainage passage 81 flows on the drainage surface 81*a* and is discharged to the outside through the drainage hole 82. At this time, for example, as illustrated in FIG. 6(*a*), when the drainage hole 82 has no drainage flow passage 82*a*, the water to be discharged to the outside stagnates in the periphery of the drainage hole 82, with the result that drainage performance is degraded. Therefore, the periphery of the drainage hole 82 in the drainage surface 81*a* is liable to be rusted. In contrast, as illustrated in FIG. 6(*b*), when the drainage hole 82 has the drainage flow passage 82*a*, the water in the periphery of the drainage hole 82 is taken into the drainage hole 82. Therefore, the water flowing on the drainage surface 81*a* is efficiently discharged to the outside.

[Relationship of Heat Exchanger, Separation Member, and Bottom Plate]

Next, description is made of a relationship of the heat exchanger 10, the separation member 20, and the bottom plate 8. As described above, the separation member 20 is provided in the drainage passage 81 of the bottom plate 8, and the heat exchanger 10 is provided on the separation member 20.

First, description is made of a relationship between the separation member 20 and the bottom plate 8, that is, in particular, a relationship between the separation member 20 and the drainage passage 81. As illustrated in FIG. 4, with a position at which the drainage surface 81*a* is provided is set as a reference position, a height $H_1$ from the reference position to the upper surface of the separation member 20 being a surface on which the heat exchanger 10 is placed is set so as to be larger than a height $H_2$ from the reference position to the upper surface of the drainage passage 81. That is, the separation member 20 is provided so that the upper surface of the separation member 20 is positioned at a position higher than the bottom surface portion 8*a* of the bottom plate 8. The height of the upper surface of the drainage passage 81 corresponds to the height of the bottom surface portion 8*a* of the bottom plate 8.

The heights of the separation member 20 and the drainage passage 81 are defined as described above, thereby being capable of preventing the contact between the heat exchanger 10, which is placed on the separation member 20, and the bottom plate 8. Further, even when the drainage passage 81 is filled with water, and the water in the drainage passage 81 further flows out, the electrical connection between the heat exchanger 10 and the bottom plate 8 due to the water having flowed out and going over the separation member 20 can be prevented.

Further, a width $W_1$ of the drainage passage 81, which is a dimension of the drainage passage 81 in a transverse direction is set so as to be larger than a width $W_2$ of the heat exchanger 10, which is a dimension of the heat exchanger 10 in a transverse direction. The "transverse direction" of each of the drainage passage 81 and the heat exchanger 10 indicates a direction corresponding to a flow direction of air, which is taken into the outdoor unit 1 by driving of the fan, subjected to heat exchange, and then discharged. That is, the width $W_1$ of the drainage passage 81 in this case corresponds to a distance between a side located on a windward side of the airflow and a side located on a leeward side of the airflow. Further, the width $W_2$ of the heat exchanger 10 corresponds to a distance between a surface located on the windward side of the airflow and a surface located on the leeward side of the airflow.

The widths of the drainage passage 81 and the heat exchanger 10 are defined as described above, thereby being capable of increasing a creepage distance between the bottom plate 8 and the heat exchanger 10. Therefore, even when the corrosion occurs in, for example, the bottom plate 8, and corrosion products or the sediments such as sand increase with the position of occurrence of the corrosion as the base point, a time period taken by those corrosion products to reach the heat exchanger 10 can be extended, thereby being capable of extending the lifetime of the manufactured product.

Further, the separation member 20 is provided in the drainage passage 81 without closing the entire drainage passage 81. For example, when the separation member 20 is provided at a location other than the inside of the drainage passage 81, for example, at the bottom surface portion 8*a* of the bottom plate 8, there may arise need for setting the outdoor unit 1 to be higher by the height of the separation member 20. In contrast, when the separation member 20 is provided in the drainage passage 81 as in this embodiment, the increase in height of the outdoor unit 1 due to the separation member 20 can be suppressed.

Next, description is made of the relationship between the drainage passage 81 and the drainage hole 82 in the bottom plate 8. As described above, the drainage hole 82 is formed into a shape being tapered downward in the vertical direction from the drainage surface 81*a*. An inclination angle 81 (see FIG. 5) of the drainage hole 82 at this time is set so as to be larger than an inclination angle 82 of the drainage surface 81*a*. The inclination angle 81 of the drainage hole 82 is defined by an angle of the drainage flow passage 82*a* with respect to a horizontal surface being perpendicular to the vertical direction. Further, the inclination angle 82 of the drainage surface 81*a* is defined by an angle of the drainage surface 81*a* with respect to the horizontal plane.

Further, a depth $h_1$ of the drainage flow passage 82*a* of the drainage hole 82 is set so as to be larger than a depth $h_2$ of the drainage surface 81*a*. The depth $h_1$ of the drainage flow passage 82*a* of the drainage hole 82 is defined by a difference in height from a connection end of the drainage flow passage 82*a* with the drainage surface 81*a* to a free end of the drainage flow passage 82*a*. Further, the depth $h_2$ of the drainage surface 81*a* is defined by a difference in height from a lowest position of the drainage surface 81*a* to a highest position of the drainage surface 81*a*.

The inclination angles and the depths of the drainage surface 81*a* and the drainage hole 82 are defined as described above. Accordingly, the water flowing through the drainage passage 81 may be likely to be taken into the drainage hole 82. Therefore, the water flowing through the drainage passage 81 can be more efficiently discharged to the outside.

As described above, the outdoor unit 1 for the air-conditioning apparatus 100 according to this embodiment includes the heat exchanger 10, the bottom plate 8, and the separation member 20. The heat exchanger 10 is provided in the main body and is configured to exchange heat between refrigerant flowing through the heat transfer tube and the air to be taken in. The bottom plate 8 forms the bottom surface of the outer shell of the main body. The separation member 20 is arranged on the bottom plate 8, receives the heat exchanger 10 placed on the separation member 20, and is configured to separate the bottom plate 8 and the heat exchanger 10 from each other.

The bottom plate 8 includes the drainage passage 81 and one or a plurality of drainage holes 82. The drainage passage 81 is formed at a position corresponding to an arrangement position of the heat exchanger 10, is formed so as to protrude downward in the vertical direction, and is configured to drain water including drain water generated in the heat exchanger 10. The drainage holes 82 are each formed so as to protrude downward in the vertical direction from the drainage passage 81 and are each configured to discharge the water flowing through the drainage passage 81 to the outside.

Further, the drainage passage 81 includes a drainage surface 81*a* inclined downward in the vertical direction toward one drainage hole 82. The drainage passage 81 has the width in the direction corresponding to the direction of the flow of air passing through the heat exchanger 10, which is set larger than the width of the heat exchanger 10 in the direction corresponding to the direction of the flow of air.

Further, the separation member 20 is formed of a metal member, which is electrically less noble than a member forming the heat exchanger 10, or a resin member. The separation member 20 is provided in the drainage passage 81 and has a shape of not closing the drainage passage 81. A height from the reference position of the drainage passage 81 to the surface on which the heat exchanger 10 is placed is set larger than a height from the reference position to the upper surface of the drainage passage 81.

As described above, the height from the reference position of the drainage surface 81*a* to the surface on which the heat exchanger 10 is placed is set larger than the height from the reference position to the upper surface of the drainage passage 81, thereby being capable of preventing the contact between the heat exchanger 10, which is placed on the separation member 20, and the bottom plate 8. Further, even in a case where the drainage passage 81 is filled with water, and the water in the drainage passage 81 flows out, the electrical connection between the heat exchanger 10 and the bottom plate 8 caused by the water having flowed out can be prevented.

Further, the width of the drainage passage 81 in the direction corresponding to the direction of the flow of air passing through the heat exchanger 10 is set larger than the width in the direction corresponding to the direction of flow of air in the heat exchanger 10, thereby being capable of increasing the creepage distance between the bottom plate 8 and the heat exchanger 10. Therefore, for example, even when the corrosion occurs in the bottom plate 8, the time period taken by the corrosion products to reach the heat exchanger 10 can be extended, thereby being capable of extending the lifetime of the manufactured product.

The present invention has been described above with reference to the embodiment, but the present invention is not limited to the above-mentioned embodiment of the present invention. Various modifications and applications can be made without departing from the gist of the present invention.

The invention claimed is:

1. An outdoor unit for an air-conditioning apparatus, comprising:

a heat exchanger, which is provided in a main body of the outdoor unit and is configured to exchange heat between refrigerant flowing through a heat transfer tube and air to be taken in;

a bottom plate forming a bottom surface of an outer shell of the main body; and a spacer, which is arranged on the bottom plate, receives the heat exchanger placed on the spacer, and is configured to separate the bottom plate and the heat exchanger from each other, the bottom plate including a drainage passage, which is formed at a position corresponding to an arrangement position of the heat exchanger, is formed so as to protrude downward in a vertical direction of the bottom plate, and is configured to drain water including drain water generated in the heat exchanger, and one or a plurality of drainage holes, wherein the one or the plurality of drainage holes are formed so as to protrude downward in the vertical direction from the drainage passage and the one or the plurality of drainage holes are configured to discharge the water flowing through the drainage passage to an outside, the drainage passage comprising a drainage surface inclined downward in the vertical direction toward one hole of the one or the plurality of drain holes, a width direction corresponding to a direction of flow of the air passing through the heat exchanger, a length direction being perpendicular to the width direction, the drainage passage having a width being a dimension in the width direction, which is larger than a width of the heat exchanger, the width of the heat exchanger being a dimension in the width direction, wherein the drainage surface is inclined longitudinally in the length direction of the heat exchanger throughout the arrangement position of the heat exchanger throughout the drainage passage toward the one hole, the spacer being formed of a metal member, which is electrically less noble than a member forming the heat exchanger, or a resin member, the spacer being provided in the drainage passage and having a shape of preventing closing of the drainage passage, wherein a height from a reference position of the drainage passage to a surface on which the heat exchanger is placed is set larger than a height from the reference position to an upper surface of the drainage passage.

2. The outdoor unit for the air-conditioning apparatus of claim 1, wherein the drainage hole has a drainage flow passage protruding downward in the vertical direction from the drainage passage, and wherein the drainage flow passage is formed into a tapered shape being tapered downward.

3. The outdoor unit for the air-conditioning apparatus of claim 2, wherein an inclination angle of the drainage flow passage with respect to a horizontal plane is larger than an inclination angle of the drainage passage with respect to the horizontal plane.

4. The outdoor unit for the air-conditioning apparatus of claim 2, wherein a depth of the drainage flow passage is larger than a depth of the drainage surface of the drainage passage.

5. An air-conditioning apparatus, comprising:

the outdoor unit for the air-conditioning apparatus of claim 1; and an indoor unit configured to perform conditioning of air in a space to be air-conditioned.

* * * * *